US007686166B2

(12) United States Patent
Kikuchi

(10) Patent No.: US 7,686,166 B2
(45) Date of Patent: Mar. 30, 2010

(54) PACKING BOX FOR PHOTOSENSITIVE RECORDING MATERIAL

(75) Inventor: Yasushi Kikuchi, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 693 days.

(21) Appl. No.: 11/546,305

(22) Filed: Oct. 12, 2006

(65) Prior Publication Data

US 2007/0145106 A1 Jun. 28, 2007

(30) Foreign Application Priority Data

Oct. 12, 2005 (JP) ..... 2005-297892

(51) Int. Cl.
*B65D 85/00* (2006.01)

(52) U.S. Cl. ..... 206/455; 206/268; 206/271; 229/125.01

(58) Field of Classification Search ..... 206/455, 206/268, 271, 273, 270, 265; 229/194, 123, 229/125.19, 127, 129.1, 173, 125.01; 378/174
See application file for complete search history.

(56) References Cited

U.S. PATENT DOCUMENTS

| | | | | | |
|---|---|---|---|---|---|
| 3,010,635 | A * | 11/1961 | Sheldon-Williams | ..... | 229/169 |
| 3,396,898 | A * | 8/1968 | Dorfmann | ..... | 229/148 |
| 4,066,205 | A * | 1/1978 | Griffith | ..... | 229/221 |
| 4,413,734 | A * | 11/1983 | Newcombe, Jr. | ..... | 206/455 |
| 5,377,835 | A * | 1/1995 | Cornelissen et al. | ..... | 206/455 |
| 5,476,218 | A * | 12/1995 | Reisman | ..... | 229/123 |
| 6,457,580 | B1 * | 10/2002 | Focke et al. | ..... | 206/259 |
| 2002/0000463 | A1 * | 1/2002 | Jaggi | ..... | 229/123 |

* cited by examiner

*Primary Examiner*—David T Fidei
(74) *Attorney, Agent, or Firm*—Sughrue Mion, PLLC

(57) ABSTRACT

A packing box for photosensitive recording material comprising a box body 5 and a lid member 9, wherein the box body 5 includes a storage section 11 and a lid-covered portion 13; the lid-covered portion 13 includes a lid-covered fixed surface 15 and a lid-covered rotatable portion 19 rotatable outward and downward along a valley bending line 17, a first lid-covered end surface 21 having an upper corner portion formed into an arcuate shape and a second lid-covered end surface 23; and the lid-covered rotatable portion 19 is formed with an inner flap 43 on the side of the second lid-covered end surface 23.

9 Claims, 8 Drawing Sheets

PACKING BOX FOR PHOTOSENSITIVE RECORDING MATERIAL

BACKGROUND OF THE INVENTION

1. Field of the Invention

The present invention relates to a packing box suitable for packing a photosensitive recording material such as an X-ray film and, more specifically, a packing box for photosensitive recording material having a structure in which a lid member can be fitted easily to a box body while preventing the lid member from being fitted in a wrong way when fitting the lid member on the box body.

2. Description of the Related Art

In the related art, a packing box 101 including a box body 103 of a rectangular shape having a longitudinal direction and a short direction in cross-section for storing a photosensitive recording material and a lid member 105 provided at an output port for the photosensitive recording material so as to be capable of shielding light as separate members as shown in FIG. 9A has been used.

In such a configuration of the packing box in the related art, a lid-covered portion 107, which is configured so that the lid member 105 can be just-fitted, is formed on an upper portion of the box body 103, and the lid-covered portion 107 includes a lid-covered fixed surface 109 (the use of the parenthesis around the reference number 107 next to the reference number 109 in the drawings is used to indicate that the lid-covered portion 107 comprises the lid-covered fixed surface 109 extending in the longitudinal direction and a lid-covered rotatable portion 113 extending in the longitudinal direction in parallel with the lid-covered fixed surface 109 and being rotatable outward and downward along a valley bending line 111 to open the output port. Two lid-covered end surfaces 115, 117 are formed on both sides of the lid-covered fixed surface 109 at a right angle thereto so as to continue from the lid-covered fixed surface and the box body 103.

An upper corner portion 119 of the lid-covered rotatable portion 113 the use of the parenthesis around the reference number 107 next to the reference number 113 in the drawings is used to indicate that the lid-covered portion 107 comprises the lid-covered rotatable portion 113) on the side of the lid-covered end surface 115 is formed into an arcuate shape. As shown in FIG. 9B, a notched portion 121 notched in a hook shape is formed under the upper corner portion 119, so that a boundary portion between the upper corner portion 119 in the arcuate shape and the notched portion 121 has a pointed distal end portion 123. The configuration of the upper corner portion 119 and the distal end portion 123 as described above is formed by mountain folding along a perforated line 125 and a line 127 indicated by a dashed line in an extension plan view as shown in FIG. 9C.

However, the pointed distal end portion 123 as described above tends to be collapsed after opening and closing the lid member 105 many times. Once the distal end portion 123 is collapsed, a lower side 106 of the lid member 105 is caught by a portion indicated by a reference numeral 122 when closing the lid member 105 from then on, and hence the smooth closing operation may be hindered. In particular, the packing box for photosensitive recording material must be opened and closed in a dark room, an operator is obliged to close the lid member 105 depending only on a sense of his/her hands. Therefore, once the lid member 105 is caught, it is difficult to release the lid member 105 from the caught state only with the sense of operator's hands.

In addition, in the configuration in the related art as described above, there is no flap existing on the both sides of the lid-covered rotatable portion 113 as shown in FIG. 10A. Therefore, when an attempt is made to cover the lid member 105 in a state in which the lid-covered rotatable portion 113 is not closed completely as shown in FIG. 10B, a back plate 120 of the lid member 105 may be wedged between the lid-covered rotatable portion 113 and the two lid-covered end surfaces 115, 117. In a bright place, such a state can be recognized immediately. However, since the packing box for photosensitive recording material is required to be opened and closed in the dark room, it is possible that the operator takes out the packing box from the dark room without noticing that the box is in the state as described above, whereby the photosensitive recording material is exposed.

SUMMARY OF THE INVENTION

In view of above-described problems of the packing box in the related art, it is an object of the invention to provide packing box for photosensitive recording material in which a portion which can easily be collapsed is eliminated from the lid-covered portion, so that a lid member can be fitted to the box body with ease and the lid member can be fitted only when the lid-covered rotatable portion is completely closed.

After having repeated keen examination, the inventors found that the above-described problem can be solved according to the packing box for photosensitive recording material in the invention having a configuration shown below.

A packing box for photosensitive recording material according to the invention includes a box body of a rectangular shape having a longitudinal direction and a short direction in cross-section for storing a photosensitive recording material and a lid member provided at an output port for the photosensitive recording material so as to be capable of shielding light as separate members, wherein the box body includes a storage section for storing the photosensitive recording material and a lid-covered portion formed on an upper portion of the storage section and configured so that the lid member can be just-fitted, wherein the lid-covered portion includes a lid-covered fixed surface extending in the longitudinal direction and a lid-covered rotatable portion extending in the longitudinal direction in parallel with the lid-covered fixed surface and being rotatable outward and downward along a valley bending line to open the output port, and a first lid-covered end surface and a second lid-covered end surface formed on both sides of the lid-covered fixed surface at a right angle thereto so as to continue from the lid-covered fixed surface and the box body, wherein the lid-covered fixed surface has an upper corner portion formed into an arcuate shape on the side of the first lid-covered end surface, wherein the lid-covered rotatable portion has an upper corner portion formed into an arcuate shape and a curved portion formed into an arcuate shape from an outermost edge of the upper corner portion toward the second lid-covered end surface immediately below the upper corner portion on the side of the first lid-covered end surface, wherein the lid-covered rotatable portion is formed with an inner flap on the side of the second lid-covered end surface, and the inner flap can be positioned inside the second lid-covered end surface in contact thereto when the lid-covered rotatable portion is closed, and can be positioned so that the lower end thereof is seated inside the second lid-covered end surface in contact thereto when the lid-covered rotatable portion is opened (first mode).

In the invention described above, the lid-covered portion may be formed of a corrugated board (second mode).

In the invention described above, the valley bending line may be formed obliquely with respect to the flute extending direction of the corrugated board (third mode).

In the invention described above, the upper corner portion of the first lid-covered end surface may be adjacent to the curved portion and formed into an arcuate shape (fourth mode).

In the invention described above, the upper side of the first lid-covered end surface may be lower than the upper side of the lid-covered fixed surface (fifth mode).

According to the first mode, since the lower position of the upper corner portion is formed into a curved shape, it is not collapsed differently from the distal end portion 123 (see FIG. 9A) in the related art even when the lid member is opened and closed a number of times, and hence a smooth closing operation of the lid member can be maintained. With the existence of the inner flap, when an attempt is made to cover the lid member in a state in which the lid-covered rotatable portion is not completely closed, the side plate of the lid member comes into abutment with the inner flap so that the lid member cannot be pressed inward any longer. Therefore, the operator can recognize that the lid-covered rotatable portion is not completely closed in the dark room, and hence the possibility that the packing box is taken out from the dark room in a state in which the lid member is not completely fitted, whereby the photosensitive recording material is exposed can be eliminated.

According to the second mode, a packing box superior in shape-retaining property and light-shielding property can be provided.

According to the third mode, although the lid-covered rotatable portion may be bent at a portion other than the valley bending line when the valley bending line is in parallel with the direction of the flute, such a phenomenon can be avoided by forming the valley bending line obliquely with respect to the flute extending direction of the corrugated board.

According to the fourth mode, since both of the curved portion and the upper corner portion of the first lid-covered end surface adjacent thereto are formed into an arcuate shape, both of them are not collapsed granted that the curved portion and the upper corner portion of the first lid-covered end surface collide with each other during the closing operation of the lid-covered rotatable portion, and hence a smooth closing operation of the lid member is ensured.

According to the fifth mode, occurrence of a situation such that when the lid member is fitted from the side of the second lid-covered end surface in an inclined posture, the lower side of the lid member comes into abutment with the upper side of the first lid-covered end surface and hence cannot be moved downward to a predetermined position may be avoided.

BEST MODE FOR CARRYING OUT THE INVENTION

Figure 1:
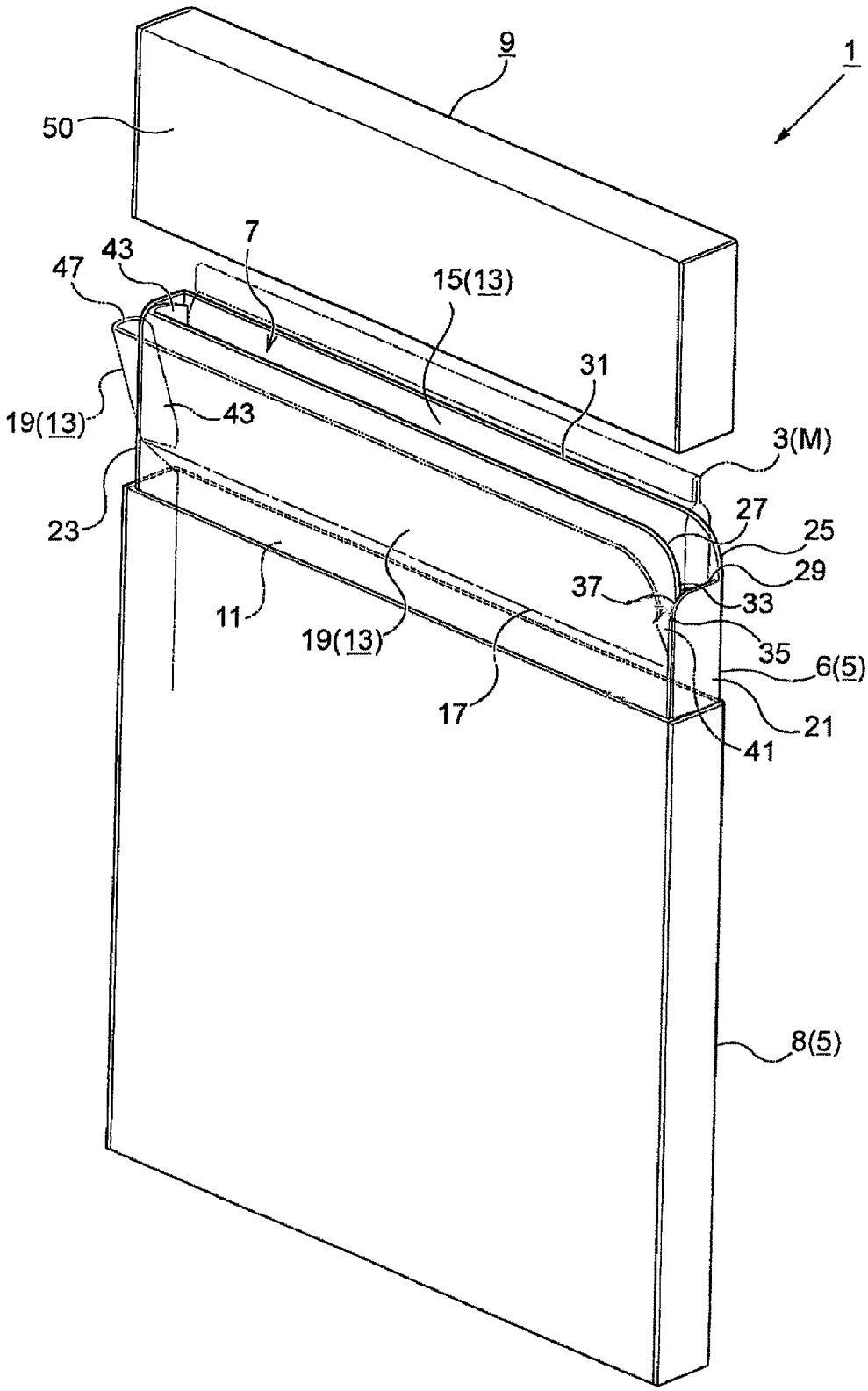
FIG. 1 is a perspective view generally showing a packing box according to the invention in the opened state.

Referring now to the drawings, a packing box for photosensitive recording material in the invention will be described in detail. Although description of the components shown below will be performed according to a representative embodiment of the invention, the invention is not limited to those embodiments. In this specification, the numerical range interposed by a sign "-" includes numerical values placed before and after the sign "-" as a lower limit value and an upper limit value.

Figure 2:
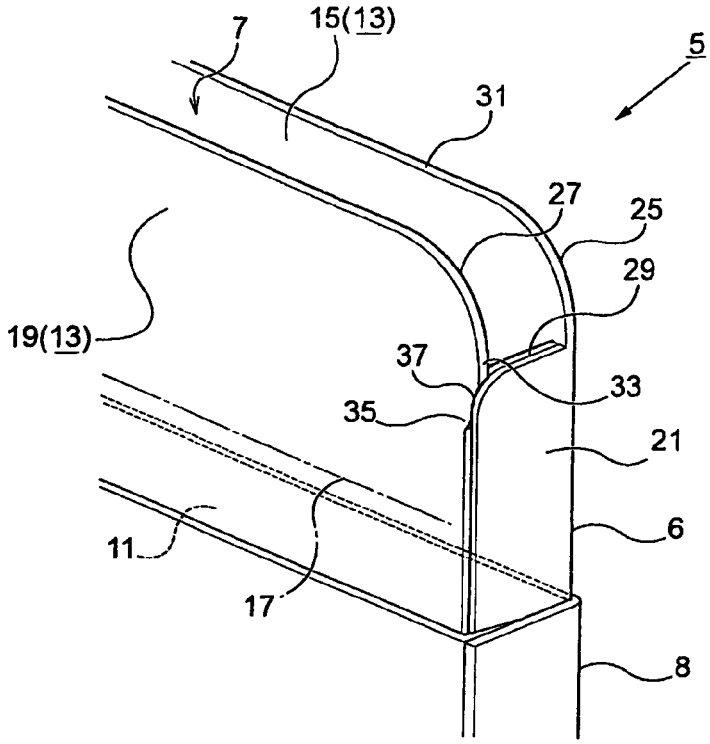
FIG. 2 is a perspective view of a lid-covered rotatable portion in the closed state.
Figure 3:
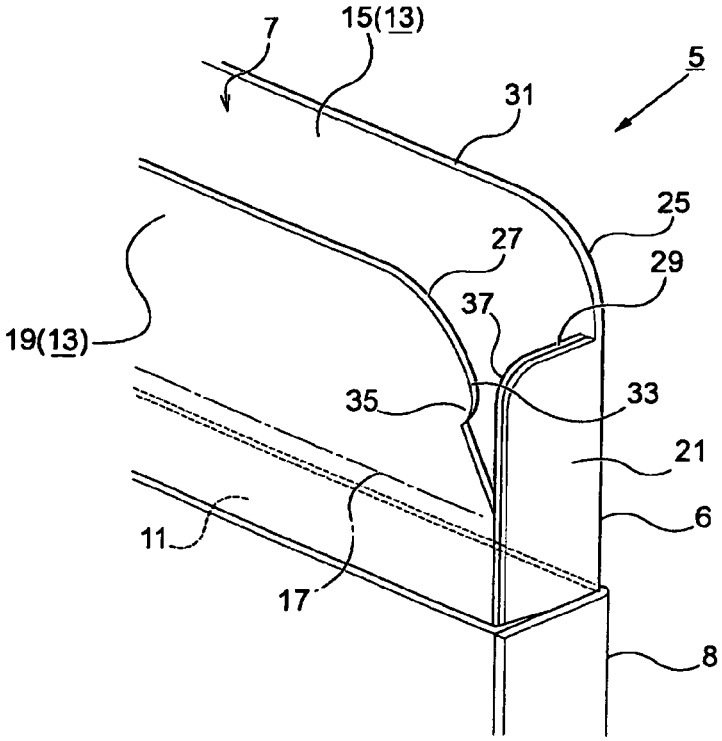
FIG. 3 is a perspective view of the lid-covered rotatable portion in the opened state.
Figure 4:
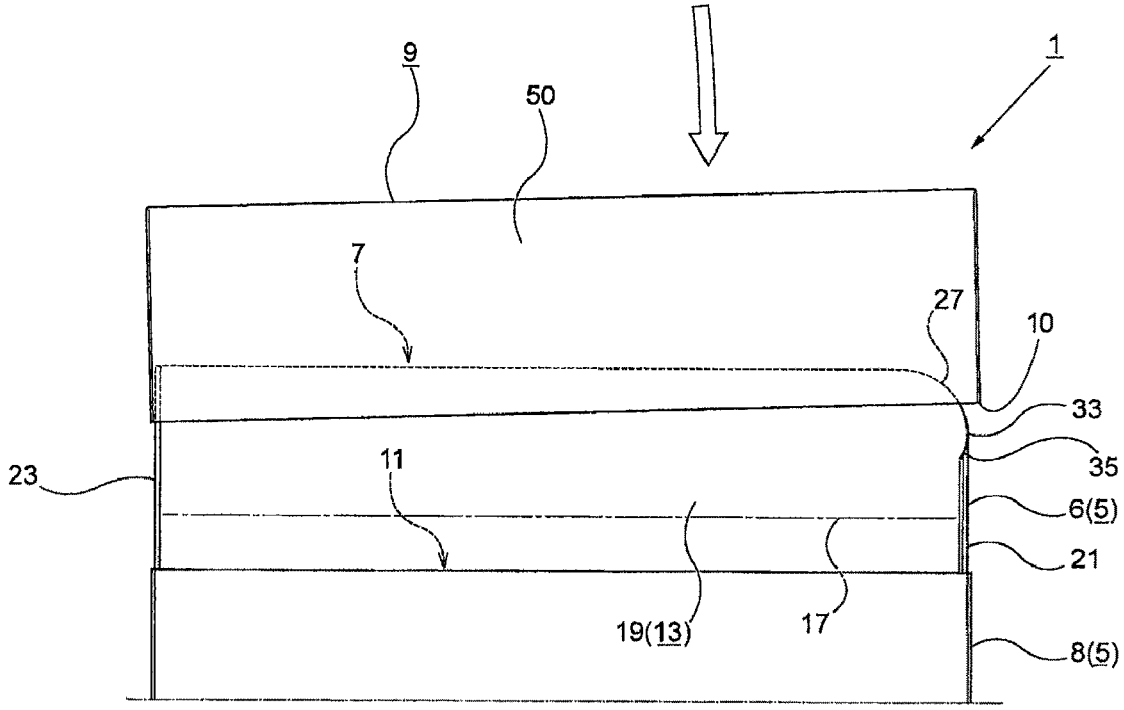
FIG. 4 is a perspective view showing a state in which a lid member is about to be fitted.
Figure 5:
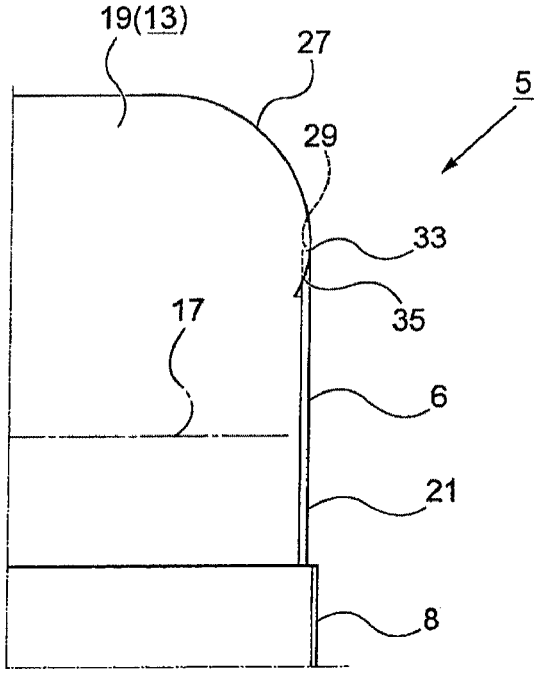
FIG. 5 is an enlarged view of the lid-covered rotatable portion on the side of a first lid-covered end surface.
Figure 6:
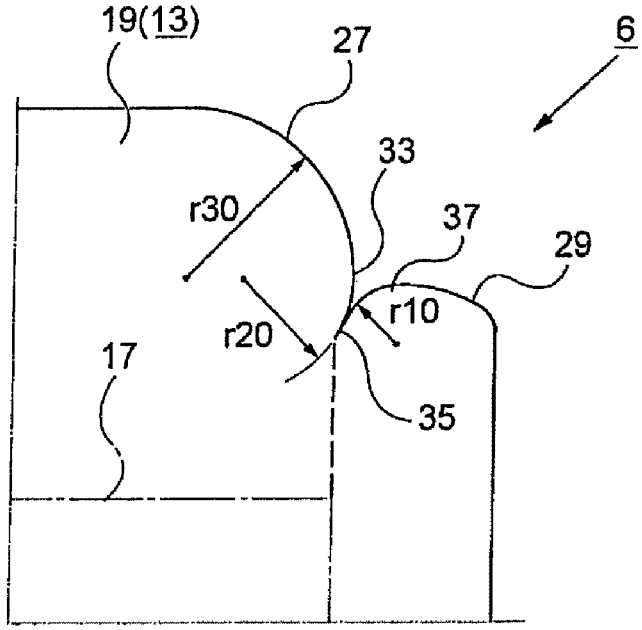
FIG. 6 is an extension plan view of a portion in the periphery of the lid-covered rotatable portion and the first lid-covered end surface.
Figure 7:
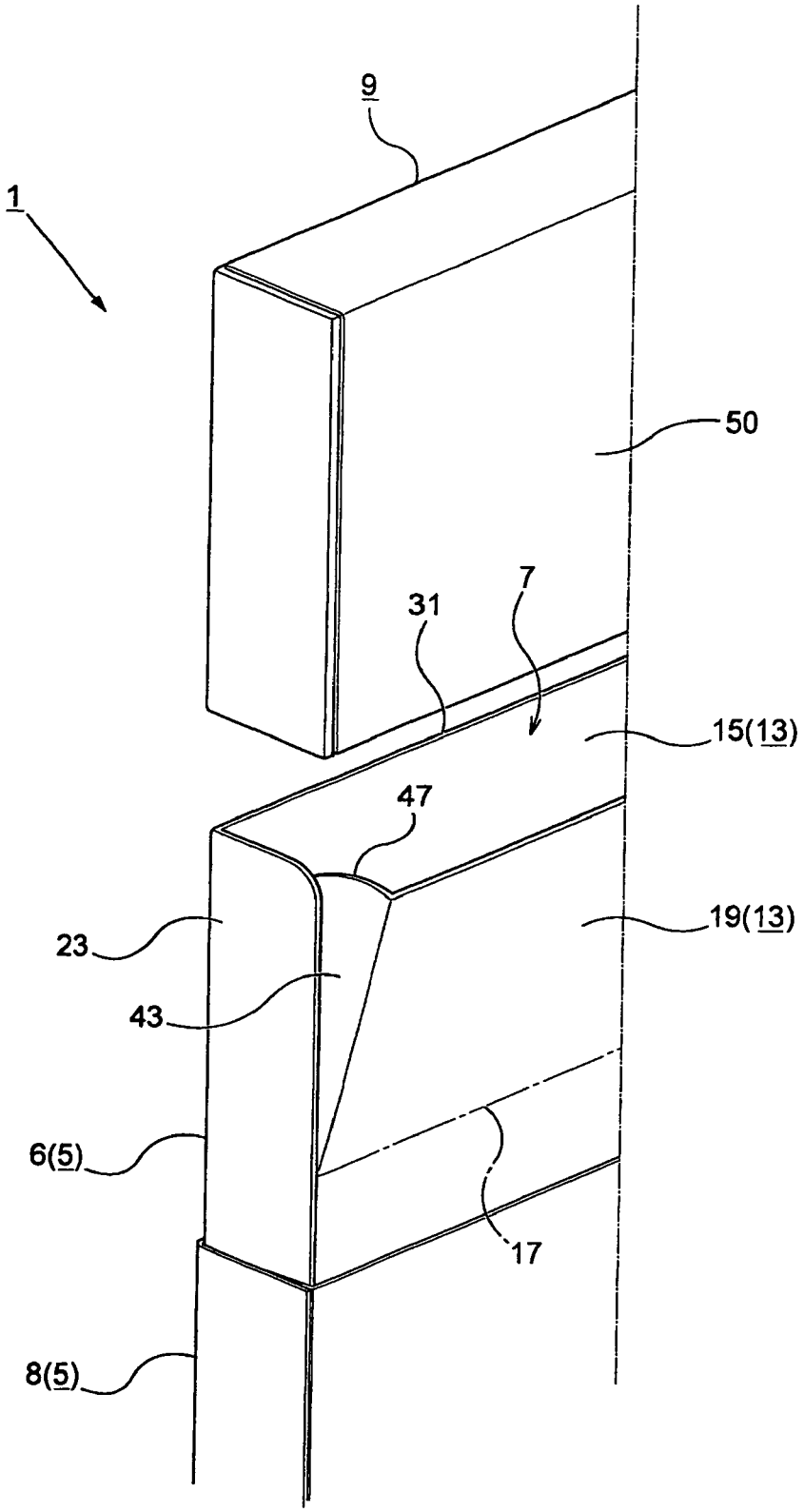
FIG. 7 is an explanatory drawing showing a case in which an attempt is made to fit the lid member when the lid-covered rotatable portion is slightly opened.
Figure 8:
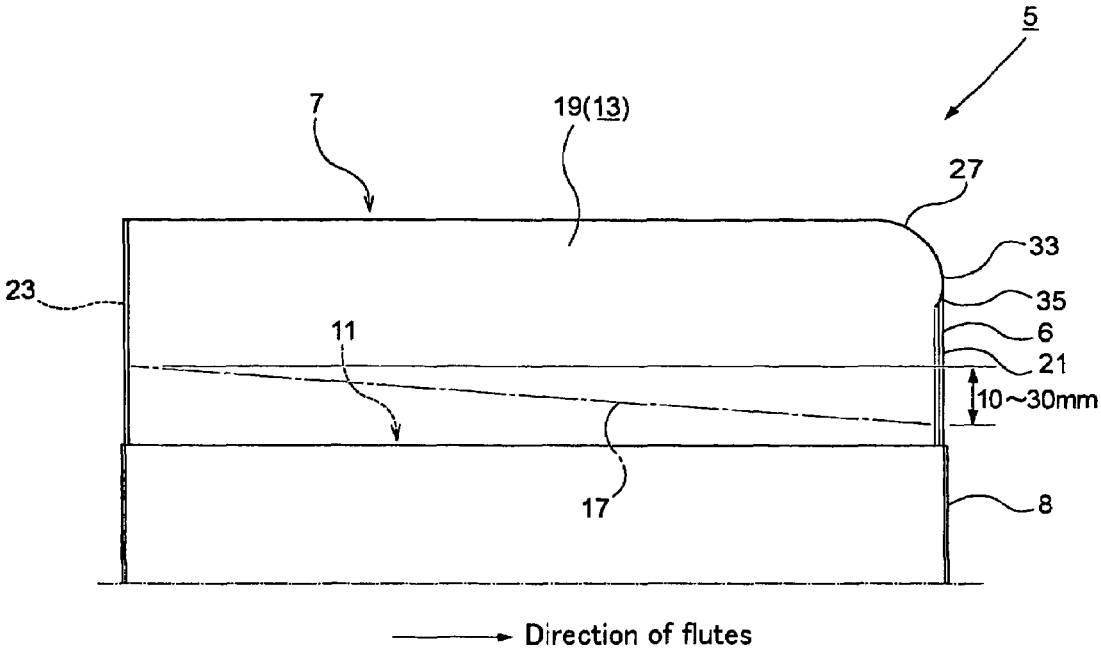
FIG. 8 is a front view showing an embodiment in which a valley bending line of the lid-covered rotatable portion is formed obliquely with respect to the flute extending direction of a corrugated board.
Figure 9:
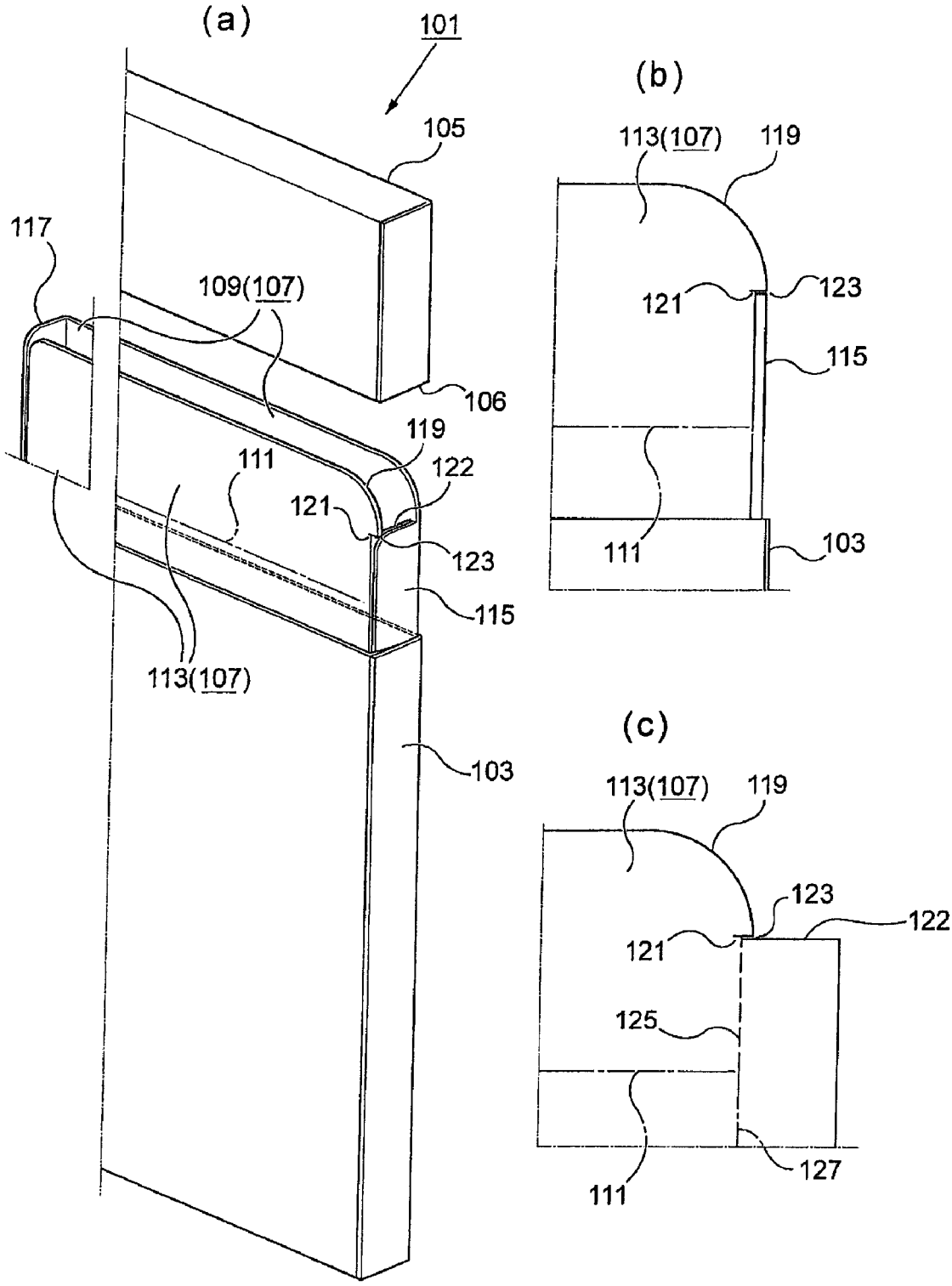
Fig.9 PRIOR ART
FIGS. 9A, 9B and 9C are perspective views of a packing box in the related art and of showing problems thereof.
Figure 10:
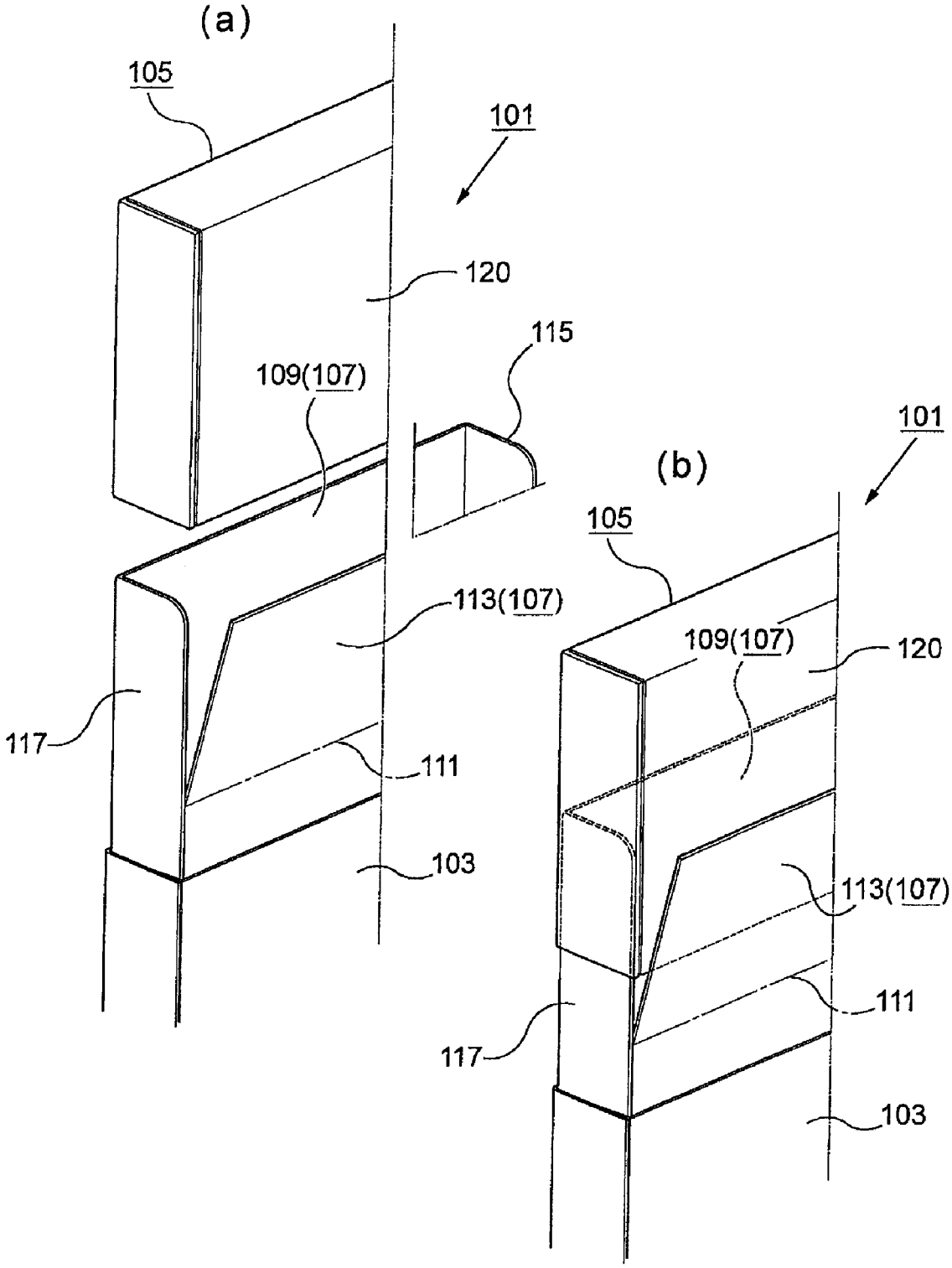
PRIOR ART Fig.10
FIGS. 10A and 10B are perspective views of the packing box in the related art and of showing problems thereof.

FIG. 1 is a perspective view generally showing a packing box for photosensitive recording material (hereinafter, referred to as a packing box) according to the invention in the opened state; FIG. 2 is a perspective view of a lid-covered rotatable portion in the closed state; FIG. 3 is a perspective view of the lid-covered rotatable portion in the opened state; FIG. 4 is a perspective view showing a state in which a lid member is about to be fitted; FIG. 5 is an enlarged view of the lid-covered rotatable portion on the side of a first lid-covered end surface; FIG. 6 is an extension plan view of a portion in the periphery of the lid-covered rotatable portion and the first lid-covered end surface; FIG. 7 is an explanatory drawing showing a case in which an attempt is made to fit the lid member when the lid-covered rotatable portion is slightly opened; FIG. 8 is a front view showing an embodiment in which a valley bending line of the lid-covered rotatable portion is formed obliquely with respect to the flute extending direction of a corrugated board; and FIGS. 9A, 9B, 9C, and FIGS. 10A and 10B are perspective views of a packing box in the related art and of showing problems thereof.

A packing box 1 in the invention includes a box body 5 of a rectangular shape having a longitudinal direction and a short direction in cross-section for storing a photosensitive recording material M sealed in an inner bag 3 and a lid member 9 provided at an output port 7 of the photosensitive recording material M so as to be capable of shielding light as separate members. The inner bag 3 (the use of the parenthesis around the reference character M next to the reference number 3 in the drawings is used to indicate that the photosensitive recording material M is inside the inner bag 3) is formed of a laminated film of paper referred to as "white granite", aluminum foil and polyethylene. An inner box 6 (the use of the parenthesis around the reference number 5 next to the reference number 6 in the drawings is used to indicate that the box body 5 comprises the inner box 6) of the box body 5 and a lid-covered portion described later of the packing box 1 in the invention is formed of a micro-flute corrugated board such as B-flute (the number of corrugation is about 50/300 mm) or E-flute (the number of corrugation is about 94/300 mm). An outer box 8 (the use of the parenthesis around the reference number 5 next to the reference number 8 in the drawings is used to indicate that the box body 5 comprises the outer box 8 of the box body and the lid member 9 are formed of paper board.

The box body 5 includes a storage section 11 for storing the photosensitive recording material M and a lid-covered portion 13 configured so that the lid member 9 is just fitted on the upper portion of the storage section 11. The lid-covered portion 13 is a portion of the inner box 6 of the box body 5 projecting upward and includes a lid-covered fixed surface 15 the use of the parenthesis around the reference number 13 next to the reference number 15 in the drawings is used to indicate that the lid-covered portion 13 comprises the lid-covered fixed surface 15) extending in the longitudinal direction and a lid-covered rotatable portion 19 the use of the parenthesis around the reference number 13 next to the reference number 19 in the drawings is used to indicate that the lid-covered portion 13 comprises the lid-covered rotatable portion 19) also extending in the longitudinal direction in parallel with the lid-covered fixed surface 15 for enabling the output port 7 to be opened by rotating outward and downward along a valley bending line 17. A first lid-covered end surface 21 and a second lid-covered end surface 23 are formed on both sides of the lid-covered fixed surface 15 so as to be bent respectively from the lid-covered fixed surface 15 at a right angle and connected to the lid-covered fixed surface 15.

The lid-covered fixed surface 15 includes an upper corner portion 25 on the side of the first lid-covered end surface 21 formed into an arc of 30 mm in radius of curvature over an angle of 90° and the lid-covered rotatable portion 19 also includes an upper corner portion 27 formed into an arc of 30 mm in radius of curvature over an angle of 90° on the side of the first lid-covered end surface 21. With the arcuate shaped upper corner portions 25, 27, when the lid member 9 is fitted in an inclined posture from the side of the second lid-covered end surface 23 (the left side in FIG. 4) as shown in FIG. 4, the lower side of the lid member 9 is guided by the arcuate shaped upper corner portions 25, 27, and hence the operator can easily press the lid member 9 downward to a predetermined position to close the packing box reliably.

An upper side 29 of the first lid-covered end surface 21 is located at a position lower than an upper side 31 of the lid-covered fixed surface 15. Therefore, occurrence of a situation such that when the lid member 9 is fitted in the inclined posture from the side of the second lid-covered end surface 23, the lower side 10 of the lid member 9 comes into abutment with the upper side 29 of the first lid-covered end surface 21 and hence cannot be moved downward to a predetermined position is avoided. The configuration such that the upper corner portions 25, 27 are formed into an arcuate shape and the configuration such that the upper side 29 of the first lid-covered end surface 21 is set to a position lower than the upper side 31 of the lid-covered fixed surface 15 depend on assumption that the lid member 9 is fitted from the side opposite from the side where such configurations are employed. Therefore, when it is assumed that the lid member 9 is fitted from the right side in FIG. 4, such configurations may be employed on the left side in FIG. 4.

The lid-covered rotatable portion 19 is formed with a curved portion 35 formed into an arcuate shape extending from an outermost edge 33 of the upper corner portion 27 toward the second lid-covered end surface 23, which is a characteristic configuration of the invention, on the side of the first lid-covered end surface 21 immediately below the arcuate upper corner portion 27. By forming the lower side of the upper corner portion 27 into a curved shape, it is prevented from being collapsed even when the lid member 9 is opened and closed a number of times as the distal end portion 123 (see FIG. 9B) in the related art, and hence a smooth closing operation of the lid member 9 can be maintained. In this embodiment, the radius of curvature of the curved portion 35 is 20 mm, and is formed over the range of about 30-45° in angle of circumference.

A position of the first lid-covered end surface 21 adjacent to the curved portion 35 is formed with an arc of 10 mm in radius of curvature over the range of 90°, to constitute an upper corner portion 37 of the first lid-covered end surface 21. Since the curved portion 35 and the upper corner portion 37 of the first lid-covered end surface 21 adjacent thereto are both formed into an arcuate shape, both of them are not collapsed granted that the curved portion 35 and the upper corner portion 37 of the first lid-covered end surface 21 collide with each other during the closing operation of the lid-covered rotatable portion 19, and hence a smooth closing operation of the lid member 9 is ensured.

The lid-covered rotatable portion 19 is formed with an inner flap 43, which is a characteristic configuration of the invention, on the side of the second lid-covered end surface 23. The inner flap 43 is positioned inside the second lid-covered end surface 23 in contact thereto when the lid-covered rotatable portion 19 is closed. When the lid-covered rotatable portion 19 is opened, the lower end of the inner flap 43 is seated inside the second lid-covered end surface 23 in contact thereto. Therefore, even when the lid-covered rotatable portion 19 is rotated outward more than 90°, the lower end of the inner flap 43 stays inside the second lid-covered end surface 23. Accordingly, a situation that the inner flap 43 protrudes to the outside of the second lid-covered end surface 23 and hence the lid member 9 cannot be fitted is avoided.

Referring now to FIG. 7, the operation of the inner flap 43 will be described. As shown in FIG. 7, in a state in which the lid-covered rotatable portion 19 is slightly opened, an upper side 47 of the inner flap 43 exists between the lid-covered rotatable portion 19 and the second lid-covered end surface 23 so as to extend across these members. Therefore, even when a back plate 50 of the lid member 9 comes to a position of a space between the lid-covered rotatable portion 19 and the second lid-covered end surface 23 by mistake when covering the lid member 9 to the lid covered portion 13, the lower side of the back plate 50 comes into abutment with the upper side 47 of the inner flap 43, so that the lid member 9 cannot be pressed downward any longer. Accordingly, since the operator can recognized that the lid-covered rotatable portion 19 is not closed completely in the dark room, the possibility that packing box 1 is taken out from the dark room in a state in which the lid member 9 is not completely fitted, whereby the photosensitive recording material is exposed can be avoided.

As described above, in this embodiment, the lid-covered portion 13 is formed of a corrugated board, and the lid-covered portion 13 is formed so that the flute of the corrugated board extends horizontally. In this case, when the valley bending line 17 is also formed horizontally, the lid-covered rotatable portion 19 may be bent at a portion other than the valley-bended line 17. When such a configuration is employed, the valley bending line 17 is preferably formed by arranging total excisions for stabilizing the bending position and stamped lines for ensuring durability alternately. For example, when the total excisions of 25 mm and the stamped lines of 25 mm or the total excisions of 15 mm and the stamped lines of 32 mm are formed alternately, a preferable characteristic is obtained.

Alternatively, the valley bending line 17 may be formed obliquely with respect to the flute extending direction of the corrugated board as shown in FIG. 8 as a modification. More specifically, when the width of the packing box 1 is 38 cm, the difference in height of the left end and the right end of the valley bending line 17 is preferably 10-30 mm. In this case as well, the valley bending line 17 can be formed by arranging the total excisions and the stamped lines alternately and, for example, the total excisions of 15 mm and the stamped lines of 32 mm may be arranged alternately.

On the other hand, when it is desired to give priority to easiness of taking-out than durability, the valley bending line 17 may be formed of a perforated line. For example, when the total excisions of 8 mm and the connected portions (nick) of 3 mm are employed, the lid-covered rotatable portion 19 can be cut off easily along the perforated line with hand.

The packing box for photosensitive recording material in the invention can be used widely as a packing box for packing various types of photosensitive recording material. In particular, it can be used preferably as a packing box for an X-ray film such as a direct radiography medical film.

The present disclosure relates to the subject matter contained in Japanese Patent Application No. 297892/2005 filed on Oct. 12, 2005, which is expressly incorporated herein by reference in its entirety.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A packing box for photosensitive recording material comprising:

a box body of a rectangular shape having a longitudinal direction and a short direction in cross-section for storing a photosensitive recording material and a lid member provided at an output port for the photosensitive recording material so as to be capable of shielding light as separate members, wherein the box body includes a storage section for storing the photosensitive recording material and a lid-covered portion formed on an upper portion of the storage section and configured so that the lid member can be fitted onto the lid-covered portion, wherein the lid-covered portion includes a lid-covered fixed surface extending in the longitudinal direction and a lid-covered rotatable portion extending in the longitudinal direction in parallel with the lid-covered fixed surface and being rotatable outward and downward along a valley bending line to open the output port, and a first lid-covered end surface and a second lid-covered end surface formed on both sides of the lid-covered fixed surface at a right angle thereto so as to continue from the lid-covered fixed surface and the box body, wherein the lid-covered fixed surface has an upper corner portion formed into an arcuate shape on the side of the lid-covered fixed surface on which the first lid-covered end surface is provided, wherein the lid-covered rotatable portion has, on a side of the lid-covered rotatable portion closest to the first lid-covered end surface, both an upper corner portion formed into an arcuate shape and a curved portion formed into an arcuate shape immediately below the upper corner portion, said curved portion extending from an outermost edge of the upper corner portion toward the second lid-covered end surface, and wherein the lid-covered rotatable portion is formed with an inner flap on a side of the lid-covered rotatable portion closest to the second lid-covered end surface, and the inner flap can be positioned inside the second lid-covered end surface in contact thereto when the lid-covered rotatable portion is closed, and can be positioned so that the lower end thereof is seated inside the second lid-covered end surface in contact thereto when the lid-covered rotatable portion is opened.

2. The packing box for photosensitive recording material according to claim 1, wherein the lid-covered portion is formed of a corrugated board having flutes.

3. The packing box for photosensitive recording material according to claim 2, wherein the valley bending line is formed obliquely with respect to the flute extending direction of the corrugated board.

4. The packing box for photosensitive recording material according to claim 1, wherein the upper corner portion of the first lid-covered end surface is adjacent to the curved portion and formed into an arcuate shape.

5. The packing box for photosensitive recording material according to claim 2, wherein the upper corner portion of the first lid-covered end surface is adjacent to the curved portion and formed into an arcuate shape.

6. The packing box for photosensitive recording material according to claim 3, wherein the upper corner portion of the first lid-covered end surface is adjacent to the curved portion and formed into an arcuate shape.

7. The packing box for photosensitive recording material according to claim 1, wherein the upper side of the first lid-covered end surface is lower than the upper side of the lid-covered fixed surface.

8. The packing box for photosensitive recording material according to claim 2, wherein the upper side of the first lid-covered end surface is lower than the upper side of the lid-covered fixed surface.

9. The packing box for photosensitive recording material according to claim 3, wherein the upper side of the first lid-covered end surface is lower than the upper side of the lid-covered fixed surface.

* * * * *